US006430913B1

(12) United States Patent
Gentry et al.

(10) Patent No.: US 6,430,913 B1
(45) **Date of Patent: *Aug. 13, 2002**

(54) METHOD OF AND APPARATUS FOR MAKING TWISTED CABLE AND THE CABLE PRODUCED THEREBY

(75) Inventors: Bobby C. Gentry; Jerry M. Hesterlee, both of Carrollton; Clinton E. Watkins, Villa Rica; James H. Sullivan, Carrollton, all of GA (US)

(73) Assignee: Southwire Company, Carrollton, GA (US)

( * ) Notice: Subject to any disclaimer, the term of this patent is extended or adjusted under 35 U.S.C. 154(b) by 0 days.

This patent is subject to a terminal disclaimer.

(21) Appl. No.: 09/314,317

(22) Filed: May 19, 1999

(51) Int. Cl.[7] ..... D07B 3/00

(52) U.S. Cl. ..... 57/314; 57/12; 57/223; 57/241; 57/258; 57/295; 57/296; 57/906

(58) Field of Search ..... 57/295, 296, 314, 57/12, 223, 241, 258, 906

(56) References Cited

U.S. PATENT DOCUMENTS 6,101,804 A * 8/2000 Gentry et al. ..... 57/296

* cited by examiner

*Primary Examiner*—Danny Worrell
*Assistant Examiner*—Shaun R Hurley
(74) *Attorney, Agent, or Firm*—Herbert M. Hanegan; Dale Lischer; Eric J. Hanson

(57) ABSTRACT

A method of and an apparatus for making twisted electrical cable, such as 600 volt secondary distribution cable, and the twisted cable product are disclosed. The apparatus comprises a first plurality of stationary payoff reels each wound with a length of bare wire conductor. The conductors are simultaneously payed off the reels to a pay out accumulator for accumulating a portion of the conductors during replacement of spent pay out reels. At least one extrusion process arranged downstream of the accumulator applies a plastic insulation material to a respective conductor as it passes through its respective extrusion process. A cooling and/or curing trough through which water is flowed cools and/or cures the plastic insulation. A take-up accumulator arranged downstream of the cooling and/or curing trough accumulates a portion of each insulated conductor during changeover of the take-up reel arranged downstream of the take-up accumulator. The take-up reel may be rotated about a first axis to twist each insulated conductor about its longitudinal axis, and may additionally simultaneously twist the insulated conductors about one another to form a twisted electrical cable. The take-up reel may also be rotated about a second axis for taking up the twisted electrical cable.

19 Claims, 7 Drawing Sheets

METHOD OF AND APPARATUS FOR MAKING TWISTED CABLE AND THE CABLE PRODUCED THEREBY

FIELD OF THE INVENTION

The present invention relates to cabling methods and apparatus, and more particularly to a method of and an apparatus for making twisted cable products, such as, for example, 600 volt secondary underground distribution (UD) cable, in a continuous in-line process.

BACKGROUND OF THE INVENTION

There are several well known methods of and apparatus making twisted electrical cable products. For example, U.S. Patent Nos. 3,686,843; 4,133,167; 4,171,609; 4,215,529; 4,426,837; 5,239,813; and 5,557,914 disclose a few of the many different types of twisting and cabling methods and apparatus which are used for twisting conductors or wires and for making twisted electrical cables. In another conventional method, a plurality of aluminum or copper wires is stranded together into a single bare stranded conductor which is then insulated with a polymeric insulation, preferably by extrusion. The extruded insulation is cured and the insulated stranded conductor is wound onto a reel, tested on its reel which is then stored for later use. Two or more of the reels of insulated stranded conductor are taken from storage and mounted in a cabling apparatus for simultaneous pay out. As the conductors are payed out from the reels, they are twisted together to form a twisted cable and the twisted cable is taken up on a reel. Typically, each insulated conductor is payed off its reel in an untwisted condition, and the conductors are then twisted together in a planetary assembly, i.e., without each individual conductor being twisted about its own longitudinal axis, by rotation of the cable take-up reel.

The aforementioned conventional method has been used heretofore to manufacture secondary electrical distribution cable, such as, for example, 600 volt triplex UD cable, and represents the state-of-the-art for manufacture of such cable. One disadvantage of the conventional method is large number of manufacturing steps involved in the manufacture of the cable. The number of manufacturing steps is increased in part because of the requirement to provide in-process handling and inventory control of the large reels of uninsulated bare conductors, of copper or aluminum, as well as in-process handling and inventory control for the same large reels after the insulation material has been extruded onto the uninsulated bare conductors and cured to form the insulated conductors that are subsequently cabled together into the twisted electrical distribution cable. Substantial in-process storage space is also required for both the large reels of bare stranded conductors, as well as for the equally large reels of insulated stranded conductors. In addition, each extrusion line for applying the plastic insulation to the conductors requires substantial plant floor space for the equipment necessary to unreel the bare stranded conductor, extrude the insulation onto the stranded conductor, cure the insulation and take-up the insulated stranded conductor on a reel. Substantial floor space is especially required for the cooling troughs necessary to cure the insulation material before the insulated stranded conductor is taken up onto a reel.

It would be desirable, therefore, to provide a method and an apparatus that reduces the in-process handling steps, the in-process storage and plant floor space requirements necessary for the conventional method and apparatus for making twisted electrical cable, such as 600 volt secondary distribution cable.

SUMMARY OF THE INVENTION

In view of the foregoing limitations and shortcomings of the prior art methods and apparatus, as well as other disadvantages not specifically mentioned above, there is still a need in the art to improve the processing of and the apparatus for manufacturing twisted electrical cable. The present invention is directed to an improved method of and an apparatus for making twisted cable and the cable manufactured thereby. The method and apparatus of the invention overcome most, if not all, the disadvantages of the prior art methods and apparatus as more fully described hereinafter.

According to the broadest aspects of the method and apparatus of the present invention, a plurality of reels containing bare stranded conductors, e.g., 19 wire stranded aluminum conductors, are mounted for simultaneous pay out of the bare stranded conductors from a plurality of stationary pay out stations. Means are provided for the simultaneous changeover or replacement of spent pay out reels with a new set of full reels of stranded conductors, including a welding station for each pay out station for welding the trailing end of a payed out stranded conductor to the leading end of a stranded conductor to be payed out. The bare stranded conductors are fed from the pay out stations to a plurality of pay out accumulators, one for each pay out station, where the conductors are accumulated during the simultaneous changeover of the stationary pay out reels and welding of the stranded conductor ends between reels.

Each of the plurality of bare stranded conductors is fed from a respective pay out accumulator separately to an extrusion station where a plastic insulation material, such as silane XLPE, is extruded onto each stranded conductor. For instance, in the case of the manufacture of a 600 volt triplex secondary distribution cable, the extrusion station may include either three separate extruders each feeding a respective extrusion crosshead and extrusion die or single or multiple extruders feeding single or multiple extrusion crossheads with multiple (advantageously three) separate extrusion dies. Preferably, a conventional stripe extruder is provided at the extrusion station for extruding surface striping, e.g., three stripes 120° apart, on one of the three extruded plastic insulations to identify the neutral conductor. The locations of the welds in each stranded conductor are marked downstream of the extruders for a purpose to be described.

After the plastic insulation is extruded onto each stranded conductor, the plastic insulation is cooled and may be cured if required, by passing the insulated conductors simultaneously through a common water cooling trough downstream of the extruder station. After cooling and/or curing of the plastic insulation, the individual insulated conductors are fed downstream to a respective take-up accumulator used to accumulate the insulated stranded conductors during changeover of the twisted cable take-up reel. From the take-up accumulators, the insulated stranded conductors are guided through a closing die and thence to a rotating take-up capstan and a take-up reel or a rotating reel take-up apparatus. The rotating reel take-up apparatus or rotation of the take-up capstan twists each individual insulated conductor about its longitudinal axis and the plurality of insulated conductors are- twisted about each other as the take-up reel simultaneously takes up the twisted cable. When the marked welds in the individual insulated stranded conductors of the twisted cable approach the take-up reel, reeling is stopped and the insulated stranded conductors are accumulated on the take-up accumulators. The welds are then; cut from the twisted cable and at the same time the full take-up reel is removed and replaced by an empty take-up reel.

Because the finished twisted cable cannot have any welds in the conductors, the welds are cut out of the conductors of the finished twisted cable before the cable is reeled onto the take-up reel. Accordingly, the welds between the trailing ends of the conductors on spent pay out reels and the leading ends of the conductors on replacement pay out reels must pass through the cabling apparatus at substantially the same time, i.e., at the same longitudinal positions relative to one another. If the welds in each insulated conductor are longitudinally spaced from one another a substantial distance during manufacture of the twisted cable, a large section of the twisted cable must be cut out and scrapped to insure that no welds remain in the finished twisted cable. For that reason, the welding operations for connecting the conductors payed out from the stationary pay out reels are preferably simultaneously performed on all conductors at the same upstream location to avoid unnecessary scrap of the finished twisted cable.

With the foregoing and other advantages and features of the invention that will become hereinafter apparent, the nature of the invention may be more clearly understood by reference to the following detailed description of the invention, the appended claims and the several views illustrated in the drawings.

DETAILED DESCRIPTION OF THE INVENTION

Figure 1:
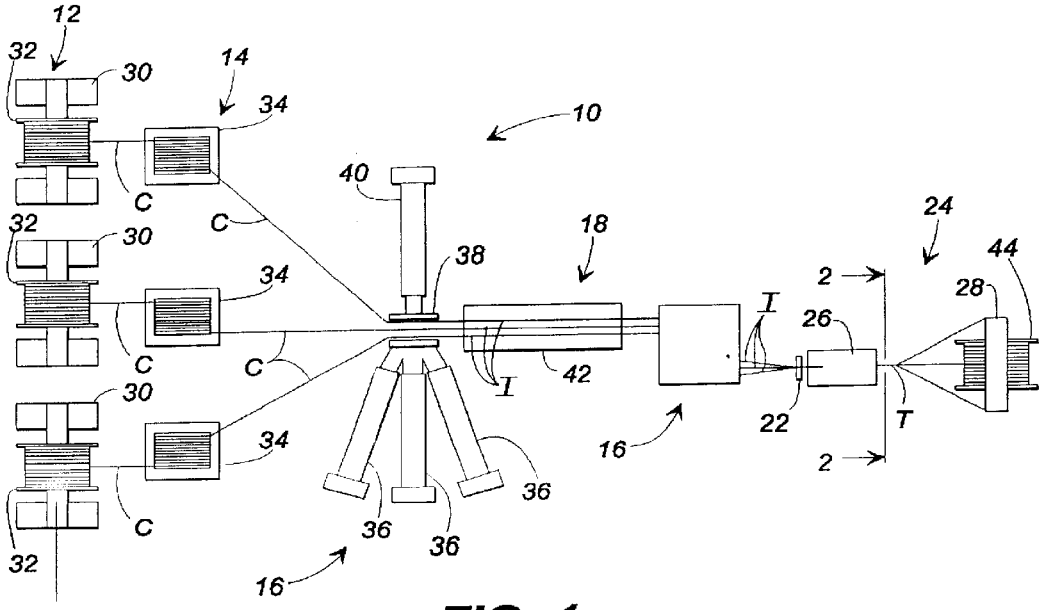
FIG. 1 is a schematic top view of the apparatus of the present invention.

Referring now to the drawings, there is illustrated in FIG. 1 a cabling apparatus according to the present invention which is designated generally by reference numeral 10. Generally, apparatus 10 comprises, from upstream to downstream, a pay out station 12, a pay out accumulator station 14, an extrusion station 16, a cooling station 18, a take-up accumulator station 20, a closing die 22, and a take-up station 24 which includes a rotating pull-out capstan 26 and rotating take-up station 28 or alternatively a rotating reel take-up apparatus. In the schematic of FIG. 1, the pay out station 12 comprises a plurality of stationary reel pay out apparatus 30, each supporting a pay out reel 32 on which is wound a bare conductor, e.g., a 19 strand aluminum wire conductor. As used herein, the term stationary pay out reel means that the pay out axis X of each reel is fixed and is not rotated about an axis perpendicular to the pay out axis X.

The bare stranded conductors C are simultaneously payed off the reels 32 to the pay out accumulator station 14 which in the schematic of FIG. 1 includes a pay out accumulator 34 for each conductor C. From the pay out accumulators 34, the bare stranded conductors C travel together to the extrusion station 16 where individual extruders 36 supply a molten plastic insulating material to separate extrusion dies. The plastic insulation material is extruded onto the bare stranded conductors passing through the extrusion dies. The plastic insulating material may be any suitable insulating material, such as silane XLPE.

In the FIG. 1 schematic, each of the extruders 36 supplies molten insulating material to one of the extrusion dies (not shown) located in single or multiple crossheads 38. It will be understood by those skilled in the art that it is also possible that the extrusion dies in the single crosshead 38 could be supplied with molten plastic by a single large extruder or that the extrusion station 16 comprises three different crossheads, one for each conductor and each being supplied with insulating material by a separate extruder.

A separate stripe extruder 40 may also be provided at the extrusion station 16 for the purpose of extruding one or more plastic stripes on the surface of the insulation of the conductor that is to be the neutral conductor of the finished twisted cable. Conventionally, three stripes spaced apart 120° of a plastic material having a different color than the insulating plastic are extruded onto the surface of the insulated neutral conductor to identify it.

As the insulated conductors I leave the extrusion station 16, they enter the cooling station 18 comprising a trough 42 through which is flowed hot water at a temperature range of about 70° C. to about 100° C. which cools and/or cures the extruded insulation on the conductors I. From the water trough 42, the insulated conductors I pass to the take-up accumulation station 20 where they are accumulated during changeover of the take-up reel. A pre-twist apparatus may be incorporated after water trough 42 which advantageously has a rotational speed of less than or equal to about two times the speed of the single-twist take-up apparatus. The pre-twist may be in the same or the opposite direction as the direction of the take-up. The pre-twist apparatus imparts a twist to the individual conductors which lessens the likelihood they will kick, cobble, or not form a twisted cable correctly.

The insulated conductors I are next guided to the closing die 22 from the take-up accumulator 20 and then to the pull out capstan 26 and take-up 28 both of which may be rotated in synchronism to twist the three insulated conductors together and simultaneously twist each insulated conductor about its own longitudinal axis. The take-up 28 supports a take-up reel 44 which takes-up the finished twisted cable T.

It will be appreciated by those skilled in the art that the twist of the insulated conductors I about one another extends upstream from the rotating capstan 26 and take-up 28 to the closing die and the twist imparted to the individual conductors about their respective longitudinal axes extends upstream past the closing die 22 to the take-up accumulator 20.

Figure 2:
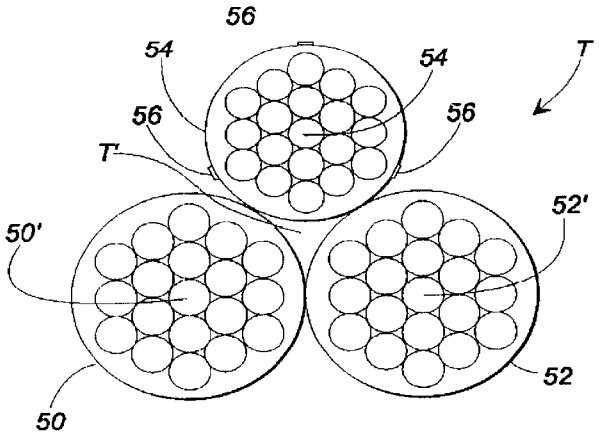
FIG. 2 is a cross-sectional view of one embodiment of a twisted cable made according to the method of the present invention using the apparatus schematically shown in FIG. 1 and taken along line 2—2 of FIG. 1.

FIG. 2 illustrates in a cross-section taken at line 2—2 of FIG. 1 the finished twisted cable T which, in the example of FIG. 2, has two nineteen (19) wire stranded conductors 50, 52 of a first given diameter and a third nineteen (19) wire stranded conductor 54 of a diameter smaller than the diameter of conductors 50 and 52. The smaller diameter of the conductor 54 is the result of using smaller diameter wires for the neutral conductor 54. Neutral conductor 54 has on the surface thereof three extruded stripes 56 applied by the stripe extruder 40.

Unlike conventional twisted cable in which the individual stranded conductors are twisted about one another in a planetary assembly, the individual conductors 50, 52 and 54 of the cable T shown in FIG. 2 are twisted in a non-planetary manner about their own axes 50', 52' and 54', as well as twisted together about the axis T' of the cable T. The external appearance of the cable T made according to the method of the present invention differs from that of the cable made according to the conventional method in that the stripes 56 on the neutral conductor 54 may be helically oriented on the conductor 54 because of the twisting of the conductor about its own axis 54'. To compensate for any tendency of the finished twisted cable T to form kinks or cobbles upon pay out because of the twist in the individual conductors about their own axes, each insulated conductor is preferably subjected to pretwisting prior to take-up either in the direction of or opposite to the direction of rotation of the single twist take-up apparatus.

Figure 3A:
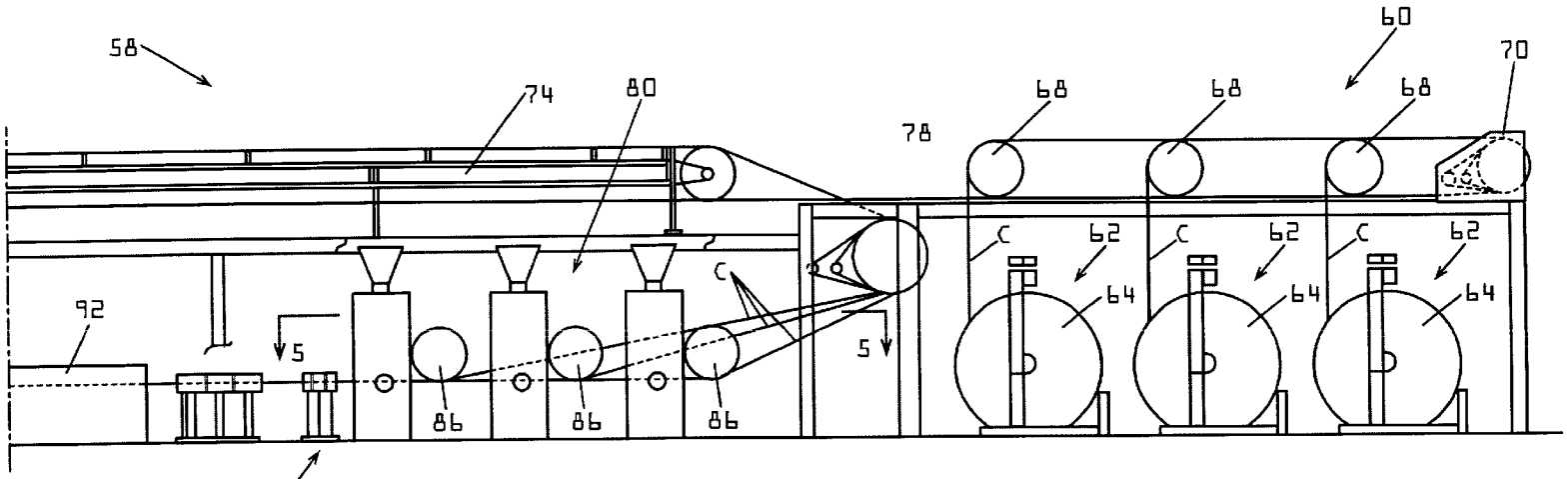
FIGS. 3A–3C are side elevation views of another embodiment of a cabling apparatus of the present invention.
Figure 3B:
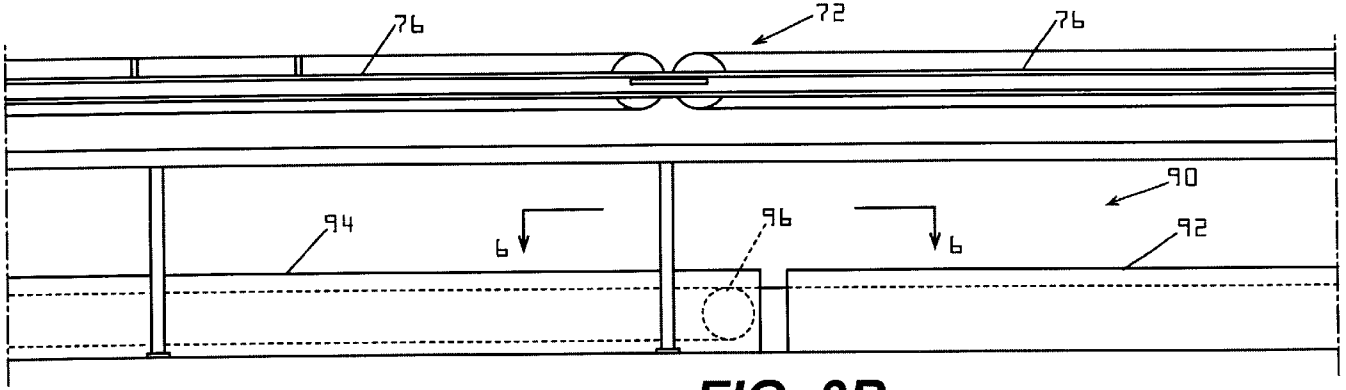
Figure 3C:
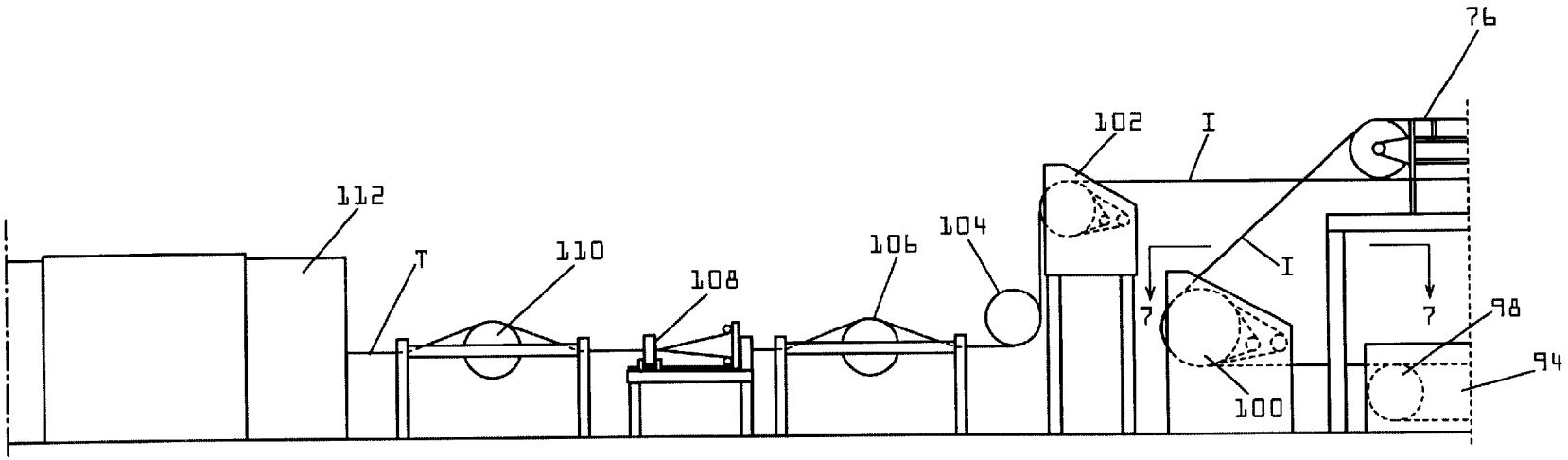
Figure 4A:
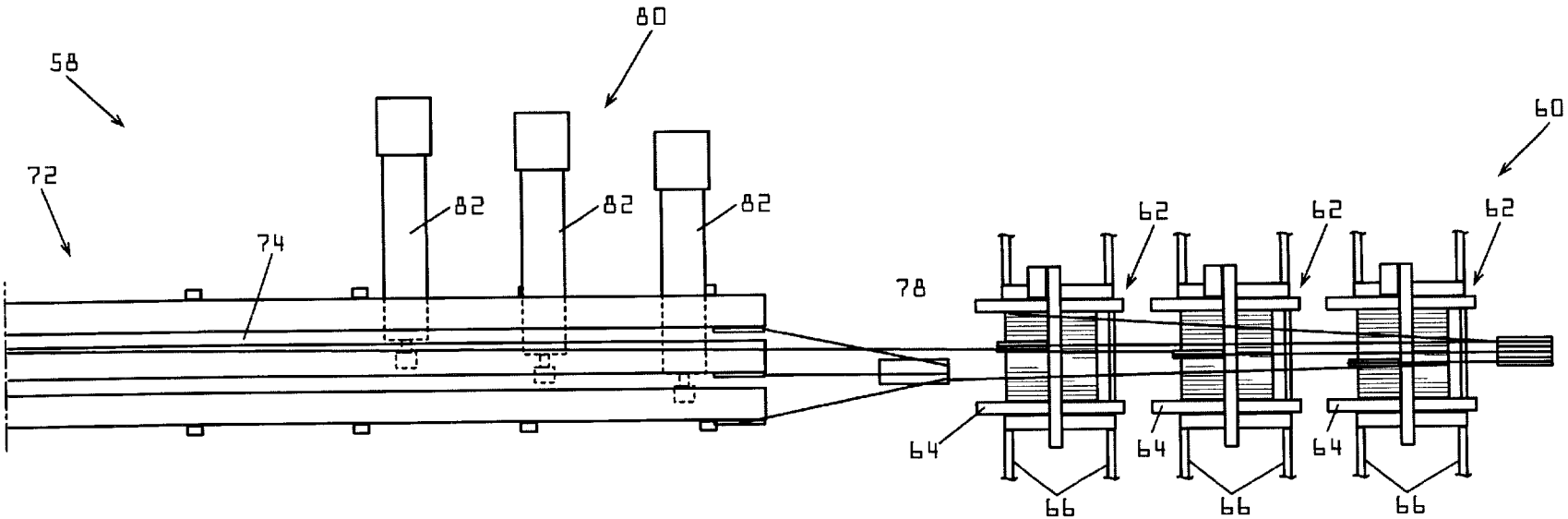
FIGS. 4A–4C are top plan views of the cabling apparatus of FIGS. 3A–3C.
Figure 4B:
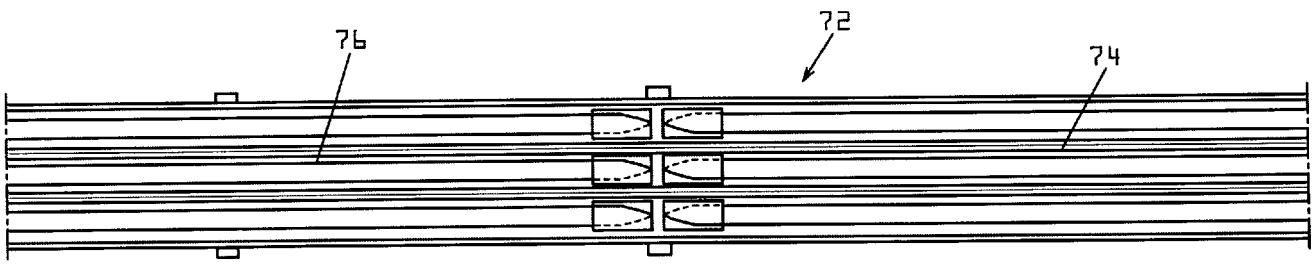

FIGS. 3A–3C, 4A–4C and 5–7 illustrate another embodiment of the cabling apparatus 58 of the present invention in greater detail than the embodiment of FIG. 1. Referring first to FIGS. 3A and 4A, the cabling apparatus 58 has a pay out station 60 comprising three in-line stationary pay outs 62 each supporting a reel 64 wound with a bare stranded conductor C. The stationary pay outs 62 are preferably mounted on tracks 66 arranged transversely to the pay out axes of the reels for movement of the stationary pay outs 62 into and out of the pay out positions shown in FIG. 4A. When the conductors on reels 64 are fully payed out, the pay outs 62 supporting the empty or spent reels are moved in one transverse direction along the tracks 66 and are replaced by pay outs 67 supporting full reels moved in the same direction along the tracks into the pay out positions shown in FIG. 4A.

The conductors C are payed out from reels 64 over guide sheaves 68 by means of a single input capstan 70. From capstan 70 the bare conductors are guided to an accumulator 72. Accumulator 72 is a combined pay out/take-up accumulator and is horizontally arranged in line with and superposed above other components of the cabling apparatus 58. Accumulator 72 includes a pay out section 74 and a take-up section 76. The pay out section 74 of the accumulator 72 accumulates the bare stranded conductors C from the pay out reels 64 during the changeover of pay out reels and welding of the trailing ends of the conductors on the spent reels to the leading ends of the conductors on the replacement pay out reels.

Figure 5:
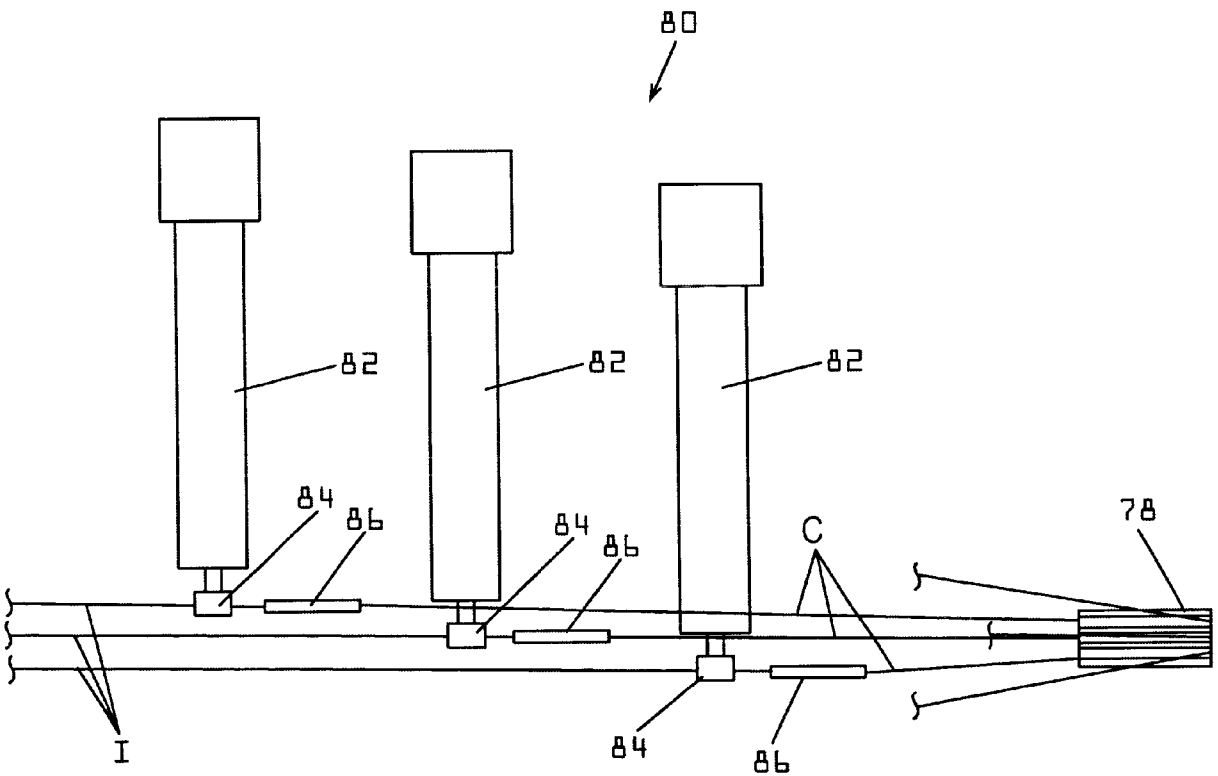
FIG. 5 is a top plan view of a portion of the cabling apparatus of the invention taken along line 5—5 of FIG. 3A.

From the pay out accumulator section 74, the bare conductors C pass to a metering capstan 78 which controls the speed of the conductors as they travel through the extrusion station 80. In this embodiment, as seen in FIGS. 3A, 4A and 5, the extrusion station 80 comprises three separate extruders 82, each of which may have crossheads 84 with a single extrusion die (not shown) for extruding a plastic insulation onto the bare stranded conductors. The crossheads 84 may be transversely and longitudinally off set as best seen in FIG. 5. A guide sheave 86 for each conductor C is arranged at the extrusion station 80 for guiding the conductors into their respective extrusion crossheads 84. A stripe extruder (not shown) may be provided at one of the crossheads 84 for extruding one or more stripes on the outer surface of the insulation of one of the conductors as described above in connection with FIG. 1.

After the insulation is extruded onto the bare stranded conductors in the crossheads 84, the insulated conductors I pass through sensor means 88 for checking the diameters of the insulated conductors. Sensor means 88 generate trim signals for controlling the screw speed of the extruders 82 in a conventional manner well known to those skilled in the art.

Figure 6:
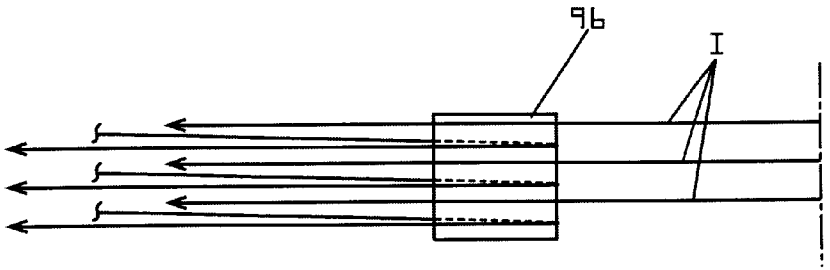
FIG. 6 is a top plan view of a portion of the cabling apparatus of the invention taken along line 6—6 of FIG. 3B.
Figure 7:
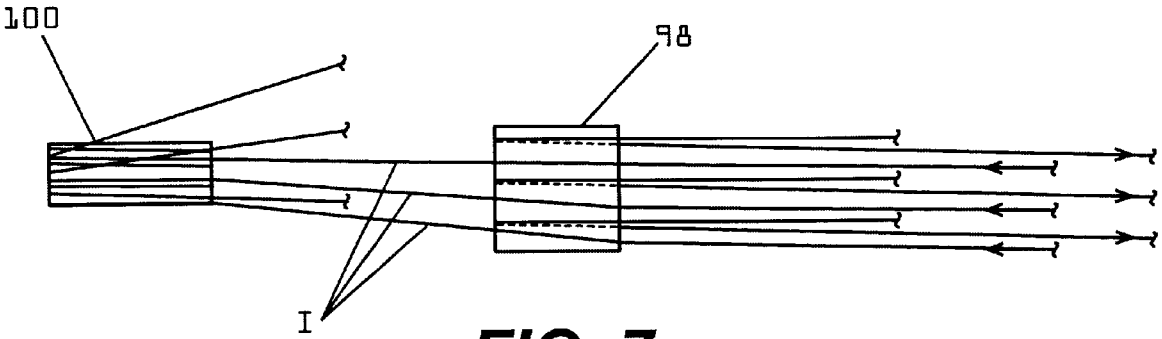
FIG. 7 is a top plan view of a portion of the cabling apparatus of the invention taken along line 7—7 of FIG. 3C.

From the extrusion station 80, the insulated conductors I pass to a cooling and/or curing station 90 located beneath the accumulator 72 as best seen in FIG. 3B. Station 90 comprises one or more troughs 92, 94 containing water for cooling and/or curing the insulation. As shown in FIGS. 3B, 6 and 7, the residence time of the insulated conductors I at station 90 may be increased by passing the insulated conductors about a pair of spaced sheaves 96, 98 (FIG. 3C) in trough 94. This arrangement effectively increases the length of the cooling/curing path of trough 94.

Figure 4C:
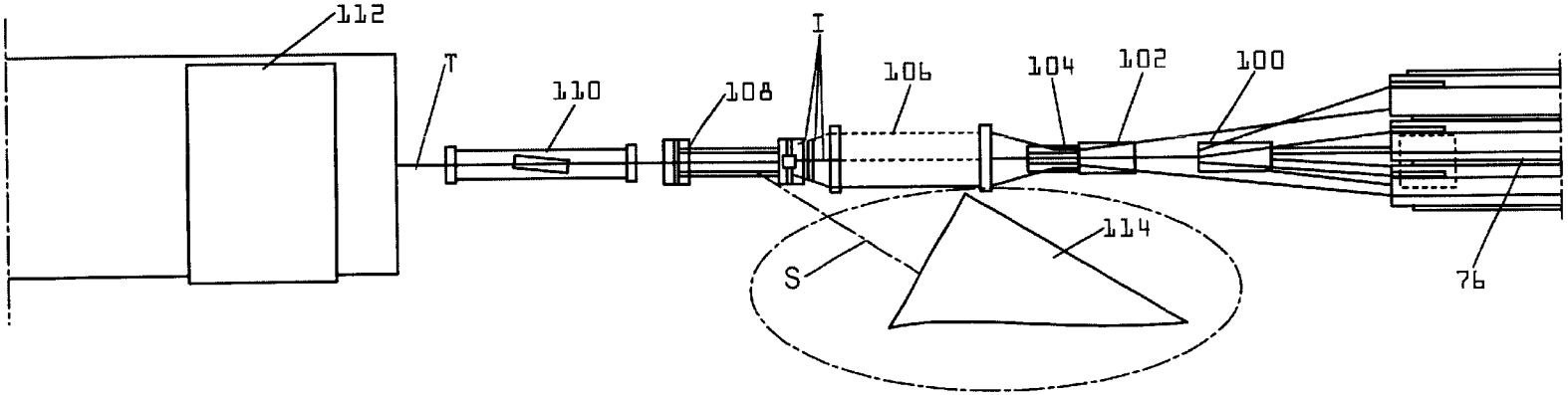

After the insulation is cooled and/or cured at station 90, the insulated conductors I pass to a pull-out capstan 100 as shown in FIGS. 3C, 4C and 7. From pull-out capstan 100, conductors I are guided intro the take-up section 76 of accumulator 72 where the conductors are accumulated during replacement of a full take-up reel with an empty take-up reel.

From the take-up accumulator section 76, the insulated conductors travel to a helper capstan 102 which assists in pulling the conductors through the accumulator section 76. The conductors are then guided around a single sheave 104 and then to a pretwister apparatus 106 which overtwists each of the conductors of the finished cable.

The conductors are then converged into a closing die 108 and the now-combined conductors are twisted into twisted cable T by a conventional rotating capstan 110 and single twist take-up apparatus 112, by an arm before the take-up or a rotating reel take-up apparatus. As will be appreciated by those skilled in the art, the twist applied to the individual conductors by the capstan 110 and take-up 112 extends upstream to the guide sheave 104 and the twist of the conductors about one another applied by the capstan 110 and take-up 112 extends upstream only to the closing die 108.

If desired, a single bare conductor S may be introduced into the closing die 108 from a single twist pay out 114 (FIG. 4C) and twisted together with the insulated conductors I to form the twisted cable T.

Although certain presently preferred embodiments of the present invention have been specifically described herein, it will be apparent to those skilled in the art to which the invention pertains that variations and modifications of the various embodiments shown and described herein may be made without departing from the spirit and scope of the invention. Accordingly, it is intended that the invention be limited only to the extent required by the appended claims and the applicable rules of law.

What is claimed is:

1. Apparatus for forming a twisted electrical cable comprising:

a first plurality of stationary payoff reels each wound with a length of bare wire conductor having upstream and downstream ends;

means for simultaneously paying off the bare wire conductors from said reels;

first accumulator means arranged downstream of said payoff reels for accumulating a portion of the bare wire conductor from each payoff reel;

an extruder process arranged downstream of said first accumulator means, each bare wire conductor passing through a respective extruder process for application of an insulation material to the bare wire conductor as it passes through the extruder process;

means arranged downstream of said extruder process for cooling and/or curing the insulation material applied to the bare wire conductors and forming a plurality of insulated conductors, each insulated conductor having a longitudinal axis;

second accumulator means arranged downstream of said cooling and/or curing means for accumulating a portion of each insulated conductor;

a take-up reel arranged downstream of the second accumulator means;

means rotating said take-up reel about a first axis for twisting each insulated conductor about its longitudinal axis and simultaneously twisting said insulated conductors about one another to form said twisted electrical cable; and means rotating said take-up reel about a second axis for taking up said twisted electrical cable onto said take-up reel.

2. The apparatus of claim 1 wherein said bare wire conductor is stranded.

3. The apparatus of claim 1, wherein said twisted electrical cable is 600 volt electrical distribution cable.

4. The apparatus of claim 1, wherein said extruder process comprises a plurality of extruders each having at least one extrusion die.

5. The apparatus of claim 4 wherein the extruders are positioned such that the extrusion dies of said extruders are arranged in spaced relation to one another from an upstream die position to a downstream die position and are laterally offset from one another in a direction transverse to the payoff direction of said stranded bare wire conductors from said payoff reels.

6. The apparatus of claim 4, wherein said extruders are positioned such that the extrusion dies of said extruders are transversely aligned and are laterally offset from one another in a direction transverse to the payoff direction of said stranded bare wire conductors from said payoff reels.

7. The apparatus of claim 1 wherein said extruder process comprises a single extruder having multiple extrusion dies.

8. The apparatus of claim 1, wherein said cooling and/or curing means comprises a trough for cooling and/or curing the extruded insulation material.

9. The apparatus of claim 1, including a closing die located downstream of said second accumulator means and upstream of said take-up reel for bringing together the insulated conductors for twisting.

10. The apparatus of claim 1 wherein said extrusion process includes three extruders each having an extrusion die, the extruders being arranged such that the extrusion dies of said extruders are spaced from one another along the direction of travel of the bare wire conductors and are laterally offset from one another in a direction transverse to the direction of travel of the bare wire conductors.

11. The apparatus of claim 1, including a pretwist apparatus which subjects each insulated conductor to a twist of the conductor about its own axis in the direction of rotation of the take-up.

12. The apparatus of claim 1, including a pretwist apparatus which subjects each insulated conductor to a twist of the conductor about its own axis in the direction opposite to the direction of rotation of the take-up.

13. The apparatus of claim 11 wherein said rotational speed of the pretwister apparatus is equal to or less than about two times the rotational speed of the take-up apparatus.

14. The apparatus of claim 12 wherein said rotational speed of the pretwister apparatus is equal to or less than about two times the rotational speed of the take-up apparatus.

15. A method of forming a twisted electrical cable comprising the steps of:

simultaneously paying off a first plurality of bare wire conductors each having upstream and downstream ends from stationary payoff reels;

accumulating a portion of the payed off bare wire conductor from each payoff reel;

simultaneously extruding an insulation material onto each bare wire conductor;

curing the insulation material applied to the bare wire conductors to form a plurality of insulated conductors, each insulated conductor having a longitudinal axis;

accumulating a portion of each insulated conductor;

twisting each insulated conductor about its longitudinal axis and simultaneously twisting said insulated conductors about one another to form said twisted electrical cable; and taking up said twisted electrical cable onto a take-up reel.

16. The method of claim 15, including the steps of providing a second plurality of bare wire conductors each having upstream and downstream ends and welding the downstream end of each bare wire conductor of said second plurality of bare wire conductors to a respective upstream end of a bare wire conductor of said first plurality of bare wire conductors.

17. The method of claim 15, wherein said step of curing the insulation material applied to the bare wire conductors includes the step of passing the insulated conductors through a water trough after extruding the insulation material onto each bare wire conductor.

18. The method of claim 17, wherein the curing step further includes flowing hot water through said trough.

19. The method of claim 18, wherein the temperature of said hot water is in the range of about 70° C. to about 100° C.

* * * * *